United States Patent [19]

Larson et al.

[11] Patent Number: 4,522,589

[45] Date of Patent: Jun. 11, 1985

[54] APPARATUS FOR DISCHARGING LIQUID-COVERED PARTICLES FROM A REACTION CHAMBER AND SUBSEQUENT DRYING OF SAID PARTICLES

[76] Inventors: Ulf R. Larson, Harabergsgatan 14, S-341 00 Ljungby; Max-Günther Schmidt, Nygårdsvägen 9, S-260 91 Förslöv, both of Sweden

[21] Appl. No.: 559,352

[22] Filed: Dec. 8, 1983

[30] Foreign Application Priority Data

Aug. 31, 1983 [SE] Sweden ..... 8304713

[51] Int. Cl.[3] ..... F27D 3/00

[52] U.S. Cl. ..... 432/239; 219/388

[58] Field of Search ..... 432/239; 219/388; 414/160, 173, 187, 189, 196, 200, 201

[56] References Cited

U.S. PATENT DOCUMENTS

| | | | |
|---|---|---|---|
| 979,937 | 12/1910 | Edwards | 432/239 |
| 1,482,677 | 2/1924 | Dunten | 414/200 |
| 3,346,368 | 10/1967 | Braunwarth et al. | 219/388 |
| 4,116,345 | 9/1978 | Greaves et al. | 414/201 |

FOREIGN PATENT DOCUMENTS

| | | | |
|---|---|---|---|
| 758503 | 3/1953 | Fed. Rep. of Germany | 432/239 |

*Primary Examiner*—John J. Camby

*Attorney, Agent, or Firm*—Allegretti, Newitt, Witcoff & McAndrews, Ltd.

[57] ABSTRACT

Apparatus for discharging liquid-covered, sedimented particles from a reaction chamber and subsequent drying of said particles, preferably metal particles which are produced in the upper portion of a reaction chamber partially filled with a liquid medium, by means of liquid-atomization or gas atomization of a stream of molten metal, whereby produced metal particles are collected at the bottom of the lower portion of said reaction chamber comprising a discharge means arranged at the bottom of said reaction chamber, said discharge means being arranged for an automatic operation and being connected to a sensing member at the bottom of said reaction chamber to sense the absence or presence of sedimented particles in said bottom in such a way that the discharging operation is automatically discontinued at a predetermined minimum quantity of collected particles and an outlet means connected to said discharge means, said outlet means being provided with a heating means and a movable motor-driven means arranged to transport said liquid-coated particles from said discharge means along said heating means, said discharge means and outlet means being arranged to prevent said particles from coming into contact with ambient air.

9 Claims, 2 Drawing Figures

APPARATUS FOR DISCHARGING LIQUID-COVERED PARTICLES FROM A REACTION CHAMBER AND SUBSEQUENT DRYING OF SAID PARTICLES

BACKGROUND OF INVENTION

The present invention relates to an apparatus for discharging liquid-covered particles from a reaction chamber and subsequent drying of said particles.

The present invention may preferably be used for removing liquid from liquid-atomized metal powder which gradually collects during the production process in the form of a slurry at the bottom of a reaction chamber. The invention will be described in the following with reference to this field of application without, however, being limited thereto.

The use of steel powders and other metal powders within the manufacturing industry has become more and more attractive. Thus the use of such metal powders for special purposes has particularly increased and recent attempts are made to produce metal powders with a certain conical form and certain size distribution in direct connection with conventional steel plants. However, such local manufacturing of special metal powders has up to now been impossible to realize under economic conditions by using known technology, due to the fact that the discharging of such produced metal powders from the reaction chamber and the following drying operation required therewith has necessitated extensive, technically complicated auxiliary equipment.

At present reaction chambers are used for the production of such metal powder, comprising a granulation chamber in which a casting ladle is arranged at the upper part of the chamber. The molten metal is poured from this casting ladle through a bottom opening and is then brought into contact with an atomizing medium flowing at high-speed, which disintegrates the casting jet into fine drops. For metal powder in which a low oxygen content is desired, the liquid-atomization is performed in reducing environment and a hydrocarbon compound or some other similar liquid is used as atomizing medium. This liquid together with the powder is collected at the bottom of the reaction chamber in the form of a slurry.

According to conventional technology the discharging and subsequent drying of the metal powder is performed in batches, i.e. the entire quantity of slurry in the reaction chamber is tapped off and transported to a plant with a vacuum filter or the like where most of the liquid is separated off and the powder is then transported to a drying plant, drying usually being performed by means of hot, flowing air. However, such a drying procedure is extremely time-consuming and thus also expensive, primarily due to the fact that the production in the reaction chamber must be interrupted every time a discharge operation is performed. Environmental problems are also considerable since work is first carried out in a wet or moist environment and thereafter in an extremely dry environment with free access to the air. There is also considerable risk of the metal powder being subjected to undesired oxidation.

SUMMARY OF THE INVENTION

It is an object of the invention to provide an apparatus for discharging moistened particles from the bottom of a reaction chamber and for subsequent drying of said discharged particles without interrupting the normal production rate of said particles.

Thus, according to the invention the discharging of moistened metal powder from said reaction chamber and subsequent drying of the particles are achieved in a unit closed off and thus separated from the surrounding atmosphere, and under such conditions that the atomizing medium may be returned to the reaction chamber in a closed system. Thus an extremely environment-friendly installation is achieved by the invention which uses little energy. Moreover, a far better quality of said dried powder is obtained.

According to the invention such an apparatus comprises a discharge means arranged at the bottom of said reaction chamber, said discharge means being arranged for an automatic operation and being connected to a sensing member at the bottom of said reaction chamber to sense the absence or presence of sedimented particles in said bottom in such a way that the discharging operation is automatically discontinued at a predeterminable minimum quantity of collected particles and an outlet means connected to said discharge means, said outlet means being provided with a heating means and a movable motor-driven means arranged to transport said liquid-coated particles from said discharge means along said heating means, said discharge means and outlet means being arranged to prevent said particles from coming into contact with ambient air.

According to a further embodiment of the invention said discharge means comprises a sluice valve arranged to regularly and at adjustable intervals discharge said particles.

Said sluice valve comprises a horizontal, thick, circular disc, pivotable about a vertical, motor-driven central shaft and sealingly located between two stationary discs, each of said three discs being provided with at least one transverse aperture arranged equidistant from said central shaft, said one transverse aperture in said upper stationary disc forming an outlet aperture from said reaction chamber, said transverse aperture in said intermediate, rotatable disc defining the dosing volume of said sluice valve and one of said transverse apertures in said lower stationary disc defining the outlet aperture from said sluice valve, said outlet apertures in said stationary discs being phase-shifted in relation to each other so that regardless of the actual position of said intermediate disc no free passage is formed through the apertures in said three discs.

According to a further embodiment of the invention the movable member in said outlet means consists of a helical arrangement pivotable about a vertical, motor-driven central shaft, said helical arrangement being arranged to transport the liquid-covered particles from the periphery in towards the centre of said heating means comprising a plan, horizontal plate provided with a centrally located outlet opening for dried particles.

Furthermore, according to the invention said outlet opening for dried particles from the outlet means is provided with a blocking means arranged to prevent the entry of air into said outlet means.

Embodiments of the invention are described below by way of example with reference to the accompanying drawings.

DESCRIPTION OF SPECIFIC EMBODIMENTS

Figure 1:
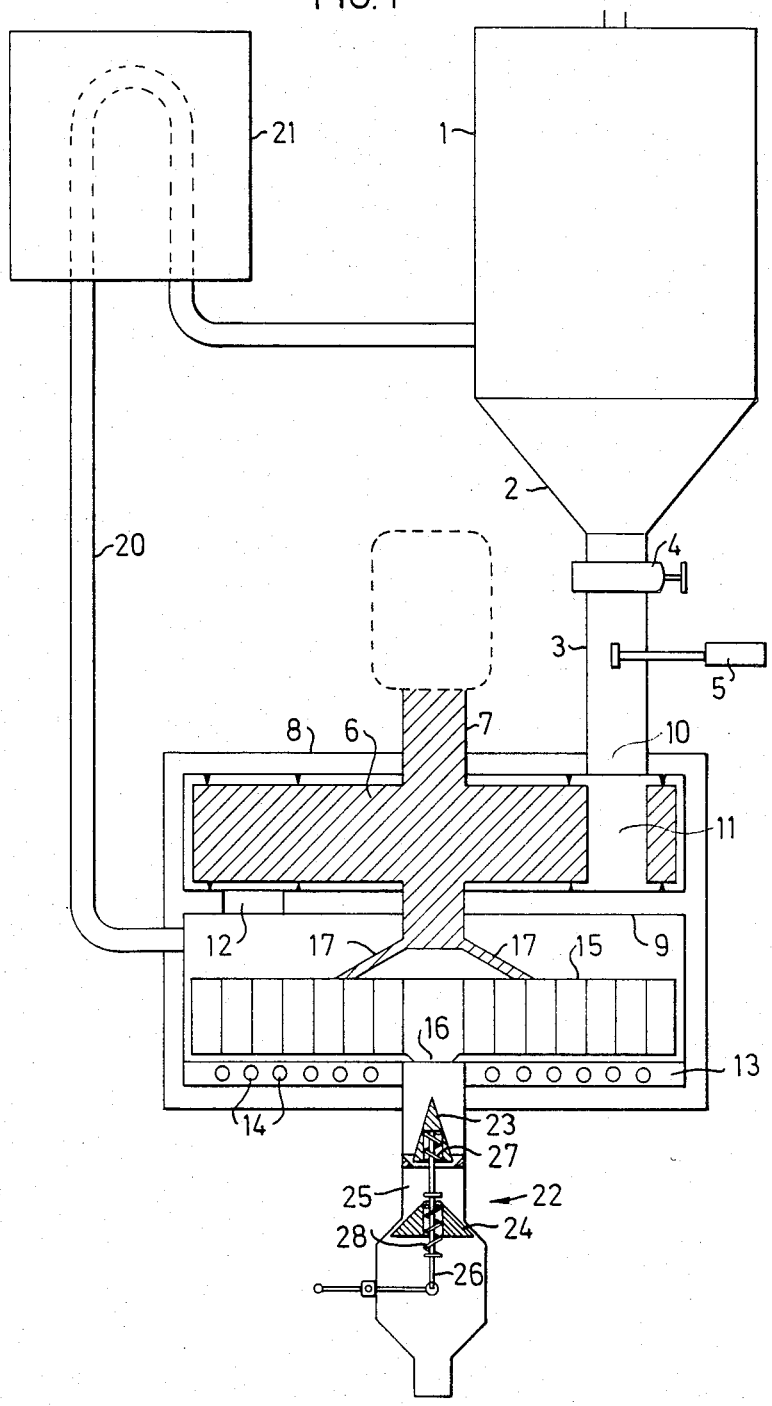
FIG. 1 is a side view of an apparatus according to the invention shown in cross-section.

Referring to FIG. 1, 1 designates a reaction chamber having a funnel-shaped lower part 2, which is at least partially filled with liquid. The tapping pipe 3 of said reaction chamber 1 is provided with a closing valve 4 and a sensing member 5. Said sensing member 5 has the ability to sense the absence or presence of sedimented particles in the tapping pipe 3, and may consist of a small, motor-driven turbine, for instance, in which case the power consumption of the motor gives an indication of the absence or presence of particles. Alternatively the sensing member may consist of a combination of radiation source and radiation-absorption gauge or the like. A sluice valve is arranged at the lower end of said tapping pipe 3. The sluice valve comprises a substantially horizontal, thick circular disc 6, made in one piece with and rotatable about a substantially vertical, motor-driven, central shaft 7. A motor is arranged to cooperate with the upper end of the central shaft 7 and, via gear reduction arranged to drive the central shaft 7 and disc 6. The motor can be stopped or started by a signal from the sensing member 5. The disc 6 is in a sealing manner located between an upper, stationary disc 8 and a lower stationary disc 9. The seals between the discs are illustrated by eight small, blocked-in triangles in FIG. 1, and these seals may consist of spring-loaded, elastomeric scrape rings or the like. The upper stationary disc 8 is provided with an aperture 10, communicating with the lower end of the tapping pipe 3. The aperture 10 corresponds in FIG. 1 to a further aperture 11 in the intermediate, pivotable disc 6. This further aperture 11 defines the dosing volume of the sluice valve. If the disc 6 is turned half way said further aperture 11 will be above an equivalent third aperture 12 in the lower stationary disc 9, and said third aperture 12 thus forms the outlet from the sluice valve. In the embodiment shown in FIG. 1 the rotatable, intermediate disc 6 has only one aperture. However, it is perfectly possible to have several apertures in this disc, in which case they should be arranged at equal angular distance from each other.

Figure 2:
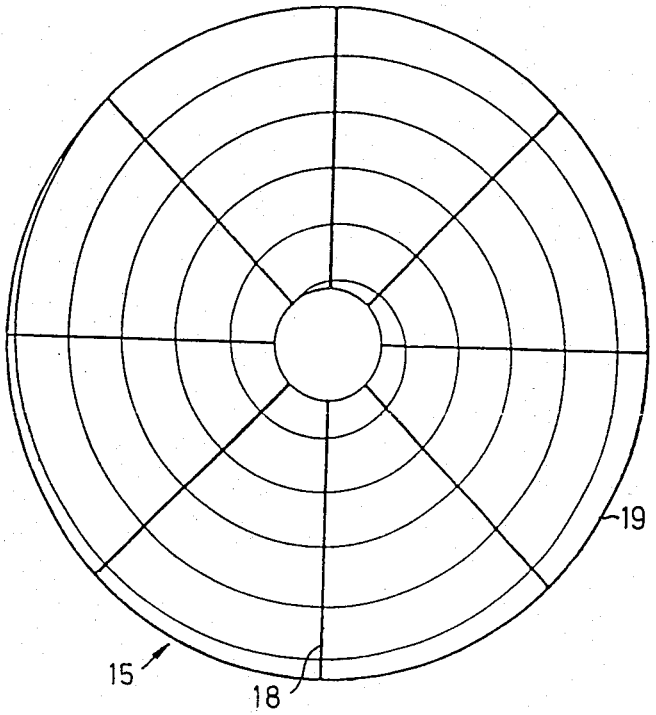
FIG. 2 is a detailed top view of the helical means in the outlet means of the apparatus shown in FIG. 1.

The slurry of particles moves downwardly through the outlet 12 and into an outlet means. The outlet means comprises a heating means in the form of a hot-plate 13, for instance, provided with electrical heating loops 14. These heating loops are preferably connected to an external electric system, not shown, via a control means enabling control and variation of the electric power supplied to the heating loops. A movable member in the form of a helical arrangement 15 is arranged above the hot-plate, which continuously spreads and transports the slurry discharge from the sluice valve along the hot-plate 13 and in towards a central outlet aperture 16 in said plate 13. The helical arrangement 15 is attached to the lower part of the motor-driven central shaft 7 of the sluice valve by means of arms 17. The helical arrangement 15 is shown in more detail, slightly enlarged, in FIG. 2. It can be seen from FIG. 2 that the helical arrangement comprises eight radially directed stiffening elements 18 for the actual helical member. These stiffening elements also serve as attachments for the arms 17. The spiral is surrounded by a stabilizing ring 19, secured to the outer ends of the stiffening elements. The part of the stiffening elements closest to the hot-plate may be toothed and project slightly below the spiral. The toothed stiffening elements may abut the hot-plate, thus serving as scrapers for the particles.

The steam produced in the outlet means is removed through a pipe 20, either due to gravity or with the help of a fan, not shown. As shown in FIG. 1, the steam may be conducted to a condensor 21 and then returned to the reaction chamber 1.

Thus the dried particles are discharged through the central outlet aperture 16 and moved against a blocking means consisting of a sluice member 22 serving as a plug-like member to prevent air from entering the outlet means. Any flow of air into the outlet means must be prevented, particularly if the removed liquid consists of a hydrocarbon which, if mixed with air, would produce an explosive mixture. The sluice member 22 consists of a closing element in the form of an upper valve cone 23 and a lower valve cone 24, with intermediate sluice space 25. The cones 23, 24 operate axially and are displaced by means of a central shaft 26. When the shaft 26 is moved upwards, the upper cone 23 is lifted, whereupon the inlet to the sluice chamber 25 is opened and when the shaft 26 is moved down, the lower cone 24 is moved down to open the outlet from the sluice chamber 25. The sluice chamber is closed by springs 27, 28.

Dimensioning of the various elements is determined so that the following operating cycle is achieved:

When the shaft 26 in its uppermost position has fully opened, it will remain in this position to allow some of the particles collected in the inlet to fall down into the sluice chamber 25, closed by the lower cone 24. The shaft 26 is then moved to its lower end position so that the inlet to the sluice chamber is closed and its outlet opened and the particles enclosed are emptied out. In this position, the movement of the shaft is restrained long enough to permit all particles to leave the sluice chamber. After this, the shaft is moved up until the lower cone 24 closes the outlet, whereupon the shaft 26 is suitably stopped in this position by a microswitch, not shown, or some other suitable means. The sluice space is now closed both at the top and at the bottom, and contains only the air which has entered while the particles were being allowed in. This air is then evacuated from the sluice chamber 25 by a vacuum pump, not shown, for instance, until a predetermined vacuum has been reached. After this a pressostat, not shown, which is initiated at this pressure, preferably re-starts the upward movement of the shaft 26 to its uppermost end position. During this time the sluice space 25 is opened at the top so that fresh, particle-shaped material can flow in, while remaining closed at the bottom.

As shown in FIG. 1, the sluice valve and outlet means may be enclosed in a common housing, preferably having heat-insulating properties.

We claim:

1. Apparatus for discharging moistened, sedimented particles from a reaction chamber and subsequent drying of said discharged particles, preferably metal particles which are produced in the upper portion of a reaction chamber partially filled with a liquid medium, by means of liquid-atomization or gas atomization of a stream of molten metal, whereby the produced metal particles are collected at the bottom of the lower portion of said reaction chamber, comprising a discharge means arranged at the bottom of said reaction chamber, said discharge means being arranged for an automatic operation and being connected to a sensing member at the bottom of said reaction chamber to sense the absence or presence of sedimented particles in said bottom in such a way that the discharging operation is automatically discontinued at a predeterminable minimum quantity of collected particles and an outlet means closed to the atmosphere and connected to said discharge means, said outlet means being provided with a heated surface and a movable motor-driven means arranged to transport said liquid-coated particles from said discharge means over said heated surface, said discharge means and outlet means being arranged to prevent said particles from coming into contact with ambient air.

2. Apparatus according to claim 1, wherein said discharge means comprises a sluice valve responsive to said sensing member.

3. Apparatus according to claim 2, wherein said sluice valve comprises a horizontal, thick, circular disc, pivotable about a vertical, motor-driven central shaft and sealingly located between two stationary discs, each of said three discs being provided with at least one transverse aperture arranged equidistant from said central shaft, said one transverse aperture in said upper stationary disc forming an outlet aperture from said reaction chamber, said transverse aperture in said intermediate, rotatable disc defining the dosing volume of said sluice valve and one of said transverse apertures in said lower stationary disc defining the outlet aperture from said sluice valve, said outlet apertures in said stationary discs being phase-shifted in relation to each other so that regardless of the actual position of said intermediate disc no free passage is formed through the apertures in said three discs.

4. Apparatus according to claim 1, wherein the movable member in said outlet means consists of a helical arrangement pivotable about a vertical, motor-driven central shaft, said helical arrangement being arranged to transport the liquid-covered particles from the periphery in towards the centre of said heating means comprising a plan, horizontal plate provided with a centrally located outlet opening for dried particles.

5. Apparatus according to claim 1, wherein said outlet opening for dried particles from the outlet means is provided with a blocking means arranged to prevent the entry of air into said outlet means.

6. Apparatus according to claim 3, wherein said outlet means is located below said sluice valve and that said central shaft for said helical arrangement is manufactured in one piece with and constitutes a downwardly directed extension of the central shaft of said sluice valve.

7. Apparatus according to claim 5, wherein said blocking means comprises a sluice member consisting of an upper valve cone and a lower valve cone with a sluice space between said cones.

8. Apparatus according to claim 7, wherein said cones are arranged to be moved in axial direction to open or close said sluice space.

9. Apparatus according to claim 5 which includes a conduit between said outlet means and said reaction chamber, and a condenser surrounding a portion of said conduit to condense liquid media flowing to said reaction chamber.

* * * * *